US011053058B2

(12) United States Patent
Alfoqaha

(10) Patent No.: US 11,053,058 B2
(45) Date of Patent: Jul. 6, 2021

(54) BASE HAVING MOUNTING PORTIONS AND ELASTIC PIECES FOR MITIGATING DAMAGING FORCES EXPERIENCED BY A DEVICE POSITIONED THEREON

(71) Applicant: International Business Machines Corporation, Armonk, NY (US)

(72) Inventor: Arshad Alfoqaha, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 100 days.

(21) Appl. No.: 16/114,116

(22) Filed: Aug. 27, 2018

(65) Prior Publication Data

US 2020/0062482 A1 Feb. 27, 2020

(51) Int. Cl.

| | |
|---|---|
| ***B65D 81/127*** | (2006.01) |
| ***B65D 19/38*** | (2006.01) |
| ***B65D 81/107*** | (2006.01) |
| ***B65D 81/05*** | (2006.01) |
| ***B65D 19/00*** | (2006.01) |

(52) U.S. Cl.

CPC ..... *B65D 81/127* (2013.01); *B65D 19/38* (2013.01); *B65D 81/107* (2013.01); *B65D 19/0026* (2013.01); *B65D 81/054* (2013.01); *B65D 2519/00029* (2013.01); *B65D 2519/00034* (2013.01)

(58) Field of Classification Search

CPC .... B65D 81/127; B65D 19/38; B65D 81/107; B65D 19/0026; B65D 2519/00029; B65D 2519/00034

USPC .... 206/521–594, 386–600; 108/57.12, 57.25

See application file for complete search history.

(56) References Cited

U.S. PATENT DOCUMENTS

| | | | | |
|---|---|---|---|---|
| 2,178,646 A | | 11/1939 | Raymond et al. | |
| 4,397,246 A | * | 8/1983 | Ishida | B65D 19/0012 108/55.3 |
| 4,911,084 A | * | 3/1990 | Sato | B65D 19/38 108/55.1 |
| 5,626,231 A | | 5/1997 | Kwong et al. | |
| 5,911,179 A | * | 6/1999 | Spiczka | B65D 19/0095 108/51.11 |
| 6,035,790 A | * | 3/2000 | Polando | B65D 19/44 108/55.1 |

(Continued)

FOREIGN PATENT DOCUMENTS

CN 204150357 U 2/2015

*Primary Examiner* — Chun Hoi Cheung

(74) *Attorney, Agent, or Firm* — Zilka-Kotab, P.C.

(57) ABSTRACT

An apparatus according to one embodiment includes a base having at least three mounting points on an upper surface thereof, an elastic block above each of the mounting points, and an elastic panel coupled to, and extending along, the upper surface of the base in a region between the mounting points. An apparatus according to another embodiment includes a base having at least three mounting points on an upper surface thereof, an elastic block above each of the mounting points, and at least two elastic pads positioned in recesses in the upper surface of the base. An apparatus according to another embodiment includes a base having at least three mounting points on an upper surface thereof, and an elastic panel coupled to, and extending along, the upper surface of the base in a region between the mounting points. The apparatus further includes at least two elastic pads.

19 Claims, 6 Drawing Sheets

(56) References Cited

U.S. PATENT DOCUMENTS

| | | | | |
|---|---|---|---|---|
| 6,240,854 | B1 * | 6/2001 | Heil | B65D 19/44 108/51.11 |
| 6,539,881 | B2 * | 4/2003 | Underbrink | B65D 19/42 108/55.3 |
| 7,845,894 | B2 * | 12/2010 | Dickinson | B65D 19/20 414/258 |
| 8,061,521 | B1 * | 11/2011 | Lowry | B65D 19/44 206/576 |
| 8,522,694 | B2 | 9/2013 | Linares | |
| 8,752,703 | B2 * | 6/2014 | De Jesus | B65D 81/1275 206/523 |
| 9,227,757 | B1 | 1/2016 | Green et al. | |
| 9,423,001 | B2 | 8/2016 | Green et al. | |
| 10,059,361 | B2 * | 8/2018 | Weisbrod | B65D 19/0002 |
| 2006/0254477 | A1 * | 11/2006 | Moore, Jr. | B65D 19/38 108/57.25 |
| 2007/0283858 | A1 | 12/2007 | Ballard | |
| 2011/0315589 | A1 * | 12/2011 | Thomas | G06F 1/1628 206/521 |
| 2014/0090581 | A1 * | 4/2014 | Schultz | F16F 15/067 108/57.12 |
| 2015/0129588 | A1 * | 5/2015 | Cline | B65D 19/0026 220/1.5 |
| 2016/0257444 | A1 | 9/2016 | Wilhelm | |
| 2016/0311572 | A1 | 10/2016 | Wilhelm | |
| 2017/0320651 | A1 * | 11/2017 | Chen | B65D 81/107 |
| 2018/0127147 | A1 * | 5/2018 | Embleton | B65D 19/42 |

* cited by examiner

BASE HAVING MOUNTING PORTIONS AND ELASTIC PIECES FOR MITIGATING DAMAGING FORCES EXPERIENCED BY A DEVICE POSITIONED THEREON

BACKGROUND

The present invention relates to systems configured to dampen damaging forces, and more particularly, this invention relates to the use of elastic materials for protecting such computer-related systems and devices thereof from being damaged.

Hardware components of computer-related systems are often moved from one location to another at least one time after manufacturing, e.g., shipped from a manufacturer to a consumer after manufacturing, moved from one office to a different office, moved about a warehouse floor, etc. During and/or as a result of such movement, components of computer-related systems are sometimes damaged. For example, if a component of a computer-related system, such as a computer rack, is dropped on the ground and/or bumped during movement, the component may experience forces, e.g. static forces, dynamic forces resulted from shock and vibrations, etc., and as a result, become damaged.

SUMMARY

An apparatus according to one embodiment includes a base having at least three mounting points on an upper surface thereof, an elastic block above each of the mounting points, and an elastic panel coupled to, and extending along, the upper surface of the base in a region between the mounting points.

An apparatus according to another embodiment includes a base having at least three mounting points on an upper surface thereof, an elastic block above each of the mounting points, and at least two elastic pads positioned in recesses in the upper surface of the base.

An apparatus according to another embodiment includes a base having at least three mounting points on an upper surface thereof, and an elastic panel coupled to, and extending along, the upper surface of the base in a region between the mounting points. The apparatus further includes at least two elastic pads positioned in recesses in the upper surface of the base.

Any of these embodiments may be implemented in a magnetic computer-related system such as a tape drive system, which may include a magnetic head, a drive mechanism for passing a magnetic medium (e.g., recording tape) over the magnetic head, and a controller electrically coupled to the magnetic head.

Other aspects and embodiments of the present invention will become apparent from the following detailed description, which, when taken in conjunction with the drawings, illustrate by way of example the principles of the invention.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The following description discloses several preferred embodiments of systems configured to dampen damaging forces, using elastic materials positioned on a base, as well as operation and/or component parts thereof.

In one general embodiment, an apparatus includes a base having at least three mounting points on an upper surface thereof, an elastic block above each of the mounting points, and an elastic panel coupled to, and extending along, the upper surface of the base in a region between the mounting points.

In another general embodiment, an apparatus includes a base having at least three mounting points on an upper surface thereof, an elastic block above each of the mounting points, and at least two elastic pads positioned in recesses in the upper surface of the base.

In another general embodiment, an apparatus includes a base having at least three mounting points on an upper surface thereof, and an elastic panel coupled to, and extending along, the upper surface of the base in a region between the mounting points. The apparatus further includes at least two elastic pads positioned in recesses in the upper surface of the base.

Conventional methods implemented for shipping devices often include strapping the device on a shipping pallet. However, during transport, devices packaged in such a manner are commonly damaged by one or a variety of forces.

Various embodiments and/or approaches described herein include an apparatus having a base and elastic components for mitigating damaging forces experienced by a device, e.g., during motion and shock and vibration, as a result of being impacted, via transmissibility, etc., when positioned thereon. The apparatus may function as a pallet for shipping a product of any type, in some approaches.

Figure 1A:
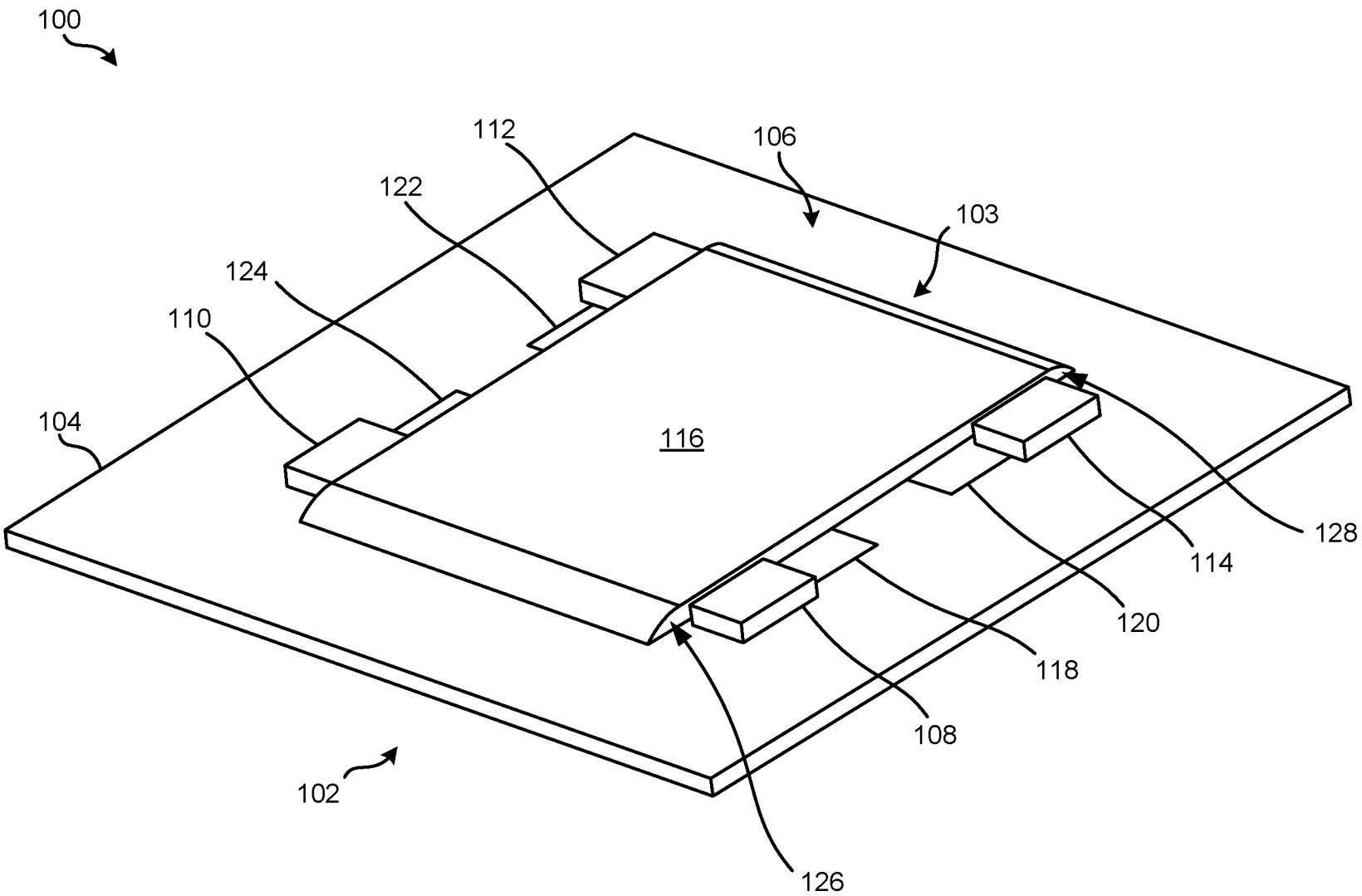
FIG. 1A is a perspective view of a system having an apparatus with a base and elastic components arranged thereon, according to one embodiment.
Figure 1B:
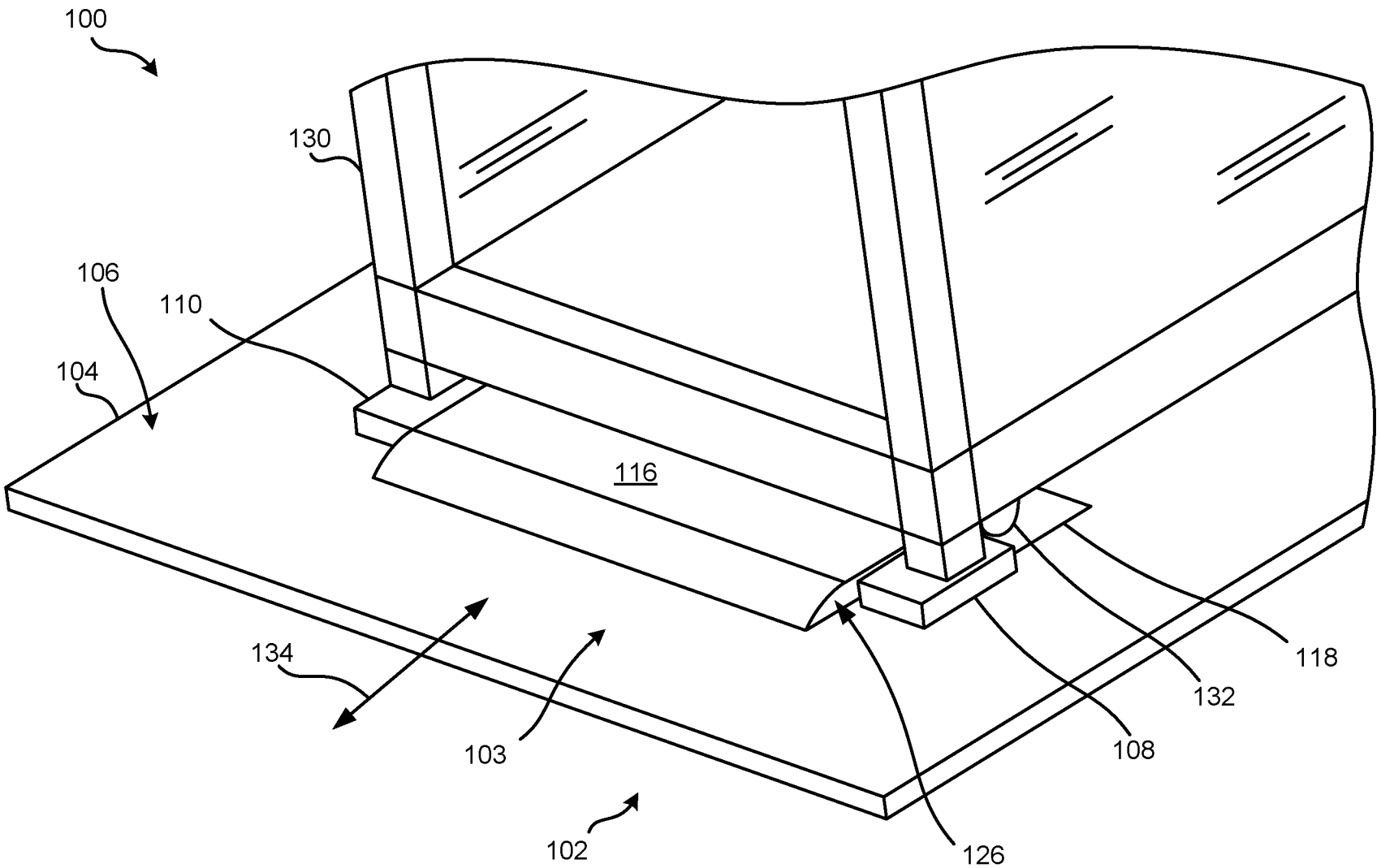
FIG. 1B is a partial perspective view of the system of FIG. 1A, and a device.

FIGS. 1A-1B depict a system 100, in accordance with one embodiment. As an option, the present system 100 may be implemented in conjunction with features from any other embodiment listed herein, such as those described with reference to the other FIGS. Of course, however, such system 100 and others presented herein may be used in various applications and/or in permutations which may or may not be specifically described in the illustrative embodiments listed herein. Further, the system 100 presented herein may be used in any desired environment.

Referring first to FIG. 1A, system 100 includes an apparatus 102 for protecting a device positioned thereon (e.g., see device 130 in FIG. 1B). In the depicted embodiment, the apparatus is configured as a shipping pallet.

Apparatus 102 includes a base 104. According to various approaches, the base 104 may be any type of material. In one approach, the base 104 is a wood panel. In another approach, the base 104 is a plastic panel. In yet other approaches, the base 104 is, e.g., a concrete panel, a metal panel, glass panel, etc.

In some approaches, the base 104 may include more than one panel and/or more than one material. For example, in such approaches, the base 104 may include various layers of material, e.g., as will be described in greater detail elsewhere herein (see FIG. 5).

The base 104 has at least three mounting points on an upper surface 106 thereof. Mounting points may include any surface that is configured to allow a component of a device and/or an elastic component to rest thereon and/or be coupled thereto. In preferred approaches, each of the mounting points reside along a common plane. However, in other approaches, one or more of the mounting points may reside on different planes.

In the present approach, apparatus 102 includes elastic blocks 108, 110, 112, 114 located above (and thereby covering) four respective mounting points of the base 104. In one approach, the elastic blocks 108, 110, 112, 114 are anchored to the base 104 at the mounting points. The elastic blocks 108, 110, 112, 114 may be anchored to the base 104 at the mounting points using any one or combination of known coupling types, e.g., adhesives, screws, bolts, etc.

However, in another approach, the elastic blocks 108, 110, 112, 114 are not anchored to the base 104, and instead rest on the mounting points of the base 104.

The elastic blocks 108, 110, 112, 114 may be used for dampening forces experienced by a device mounted to the base, as will soon be described in greater detailed elsewhere herein, e.g., see FIG. 1B.

Apparatus 102 further includes an elastic panel 116 coupled to, and extending along, the upper surface 106 of the base 104 in a region 103 between the mounting points. According to various approaches, the elastic panel 116 includes at least one tapered end, e.g., see tapered end 126 and tapered end 128. Tapered ends of the elastic panel 116 will be described in greater detail elsewhere herein, e.g., see FIG. 1B.

Apparatus 102 further includes at least two elastic pads 118, 120, 122, 124 positioned in recesses in the upper surface 106 of the base 104. It should be noted that the recesses in the upper surface 106 are not entirely visible in FIGS. 1A-1B, because the elastic pads 118, 120, 122, 124 are shown positioned in the recesses. Accordingly, only a contour of each of the recesses is shown with a respective elastic pad 118, 120, 122, 124 positioned therein.

In the present approach, upper surfaces of the elastic pads 118, 120, 122, 124 are about coplanar with the upper surface 106 of the base 104. However, in other approaches, the upper surfaces of the elastic pads 118, 120, 122, 124 may not be about coplanar with the upper surface 106 of the base 104. For example, in one approach, at least some of the upper surfaces of the elastic pads 118, 120, 122, 124 may reside above the upper surface 106 of the base 104 to support a portion of a device, e.g., a leg of a computer rack, that is placed thereon. Moreover, at least some of the upper surfaces of the elastic pads 118, 120, 122, 124 may additionally and/or alternatively reside below the upper surface 106 of the base 104 to support a portion of a device placed thereon.

According to various approaches, any of the elastic pads 118, 120, 122, 124 and/or the elastic blocks 108, 110, 112, 114 and/or the elastic panel 116 may include any known type of elastic material. For example, the elastic material may include any one or more of, e.g., natural rubber materials, synthetic rubber materials, foam, known polymers such as elastomer, etc., or any combination thereof. Preferably, the elastic material is resiliently deformable.

Moreover, any of the elastic pads 118, 120, 122, 124 and/or the elastic blocks 108, 110, 112, 114 and/or the elastic panel 116 may be secured to the base 104 using any one or combination of known coupling types. For example, in one approach, one or more of such components are coupled to the base 104 using adhesives. In another approach, one or more of such components are coupled to the base 104 using screws. In another approach, one or more of such components are coupled to the base 104 using hook and loop fasteners. In yet another approach, one or more of such components are coupled to the base 104 using magnets.

In another approach, any of such components may alternatively only be placed on the upper surface 106 of the base 104 and/or in a recess thereof, without being coupled thereto. In such an approach, the weight of a device placed on the base 104 may sandwich and thereby secure any one or more of such components to the upper surface 106 of the base 104.

Referring now to FIG. 1B, the apparatus 102 includes a device 130, e.g., such as a computer rack, mounted to the base 104 at the mounting points. Specifically, in the present approach, the elastic blocks 108, 110, 112, 114 extend between the device and the mounting points for providing damping. It may be noted that the device 130 obstructs the view of the elastic blocks 112, 114 in FIG. 1B.

Damping is provided at least in part by the elastic characteristics of the elastic blocks 108, 110, 112, 114. For example, the elasticity of the elastic blocks 108, 110, 112, 114 dampens/reduces energy that might otherwise be transferred from the base 104 to device 130 without such elastic blocks 108, 110, 112, 114 being present. More specifically, this dampening/reduction of energy significantly reduces transmissibility of energy to the device 130, and therefore mitigates damage of the device 130 and/or any components installed in the device 130, thereby mitigating damage of the device 130 and/or any components installed in the device 130. Assume for purposes of another example that the device 130 is a computer rack. Material characteristics of the elastic blocks 108, 110, 112, 114 provide dampening and/or a reduction of transmissibility of energy to both the computer rack frame itself, and computers within the computer rack.

Of course the elastic properties of other components of apparatus 102 also dampen energy that would otherwise be transmitted to the device 130. For example, the elastic pads 118, 120, 122, 124 are for receiving wheels 132 of a device thereon. For example, in the present approach, the wheels 132 of the of the device 130 rest on the elastic pads 118, 120, 122, 124 (elastic pads 120, 122, 124 obstructed from view in FIG. 1B). Accordingly, the elastic pads 118, 120, 122, 124 dampen energy that might otherwise be transmitted to the device 130, at least in part through the wheels 132 of the device 130. For example, such energy may be generated, e.g., in response to apparatus 102 being set down on a hard surface, in response to apparatus 102 being bumped during transit while the apparatus 102 is positioned inside a delivery truck, in response to the base 104 being struck by something, etc.

It should be noted that although only one wheel 132 of the device 130 is shown in FIG. 1B, it may be assumed that the device includes at least three wheels and/or legs. Accordingly, various descriptions herein referring to "wheels" of the device 130 may refer to each of such wheels 132 and/or legs (not shown) of the device 130.

The elastic panel 116 also may dampen energy from being transmitted to the device 130. For example, at least a portion of the device 130 rests on at least a portion of the elastic panel 116 when the device 130 is positioned over the elastic panel 116. Specifically, in the present approach, the elastic panel 116 is configured to fit between the wheels, and therefore an underside of the device 130 may rest on the elastic panel 116.

In some approaches, the elastic blocks 108, 110, 112, 114 are configured to selectively prevent the device 130 from rolling off the base 104. For example, in one approach each of the elastic blocks 108, 110, 112, 114 are detachably coupled to the mounting points for allowing the device 130 to be rolled onto and/or off of the base 104 in a first direction 134. Moreover, the elastic blocks 108, 110, 112, 114 may be secured to the mounting points of the base 104, e.g., once the elastic pads 118, 120, 122, 124 receive the wheels 132 of the device thereon, and thereby prevent the device 130 from rolling onto or off of the base 104 in a first direction 134. It should be noted that in one approach, the tapered ends 126, 128 of the elastic panel 116 allow the device 130 to roll off of the base 104 without hanging up on the elastic panel 116.

However, in another approach, the elastic blocks 108, 110, 112, 114 are fixedly coupled to the mounting points. In such an approach, the device 130 may be placed onto the base 104, e.g., such that the elastic pads 118, 120, 122, 124 receive the wheels 132 of the device thereon.

It should be noted that although in the present embodiment apparatus 102 includes the elastic blocks 108, 110, 112, 114, the elastic pads 118, 120, 122, 124, and the elastic panel 116, as will now be described, apparatuses of other embodiments may include different configurations and/or compositions of elastic components, e.g., see FIGS. 2-5.

FIGS. 2-5 depict systems 200-500, in accordance with various embodiment. As an option, the present systems 200-500 may be implemented in conjunction with features from any other embodiment listed herein, such as those described with reference to the other FIGS. Of course, however, such systems 200-500 and others presented herein may be used in various applications and/or in permutations which may or may not be specifically described in the illustrative embodiments listed herein. Further, the systems 200-500 presented herein may be used in any desired environment.

It should be noted that one or more of the components of systems 200-500 may include one or more common numberings with similar components of system 100.

Figure 2:
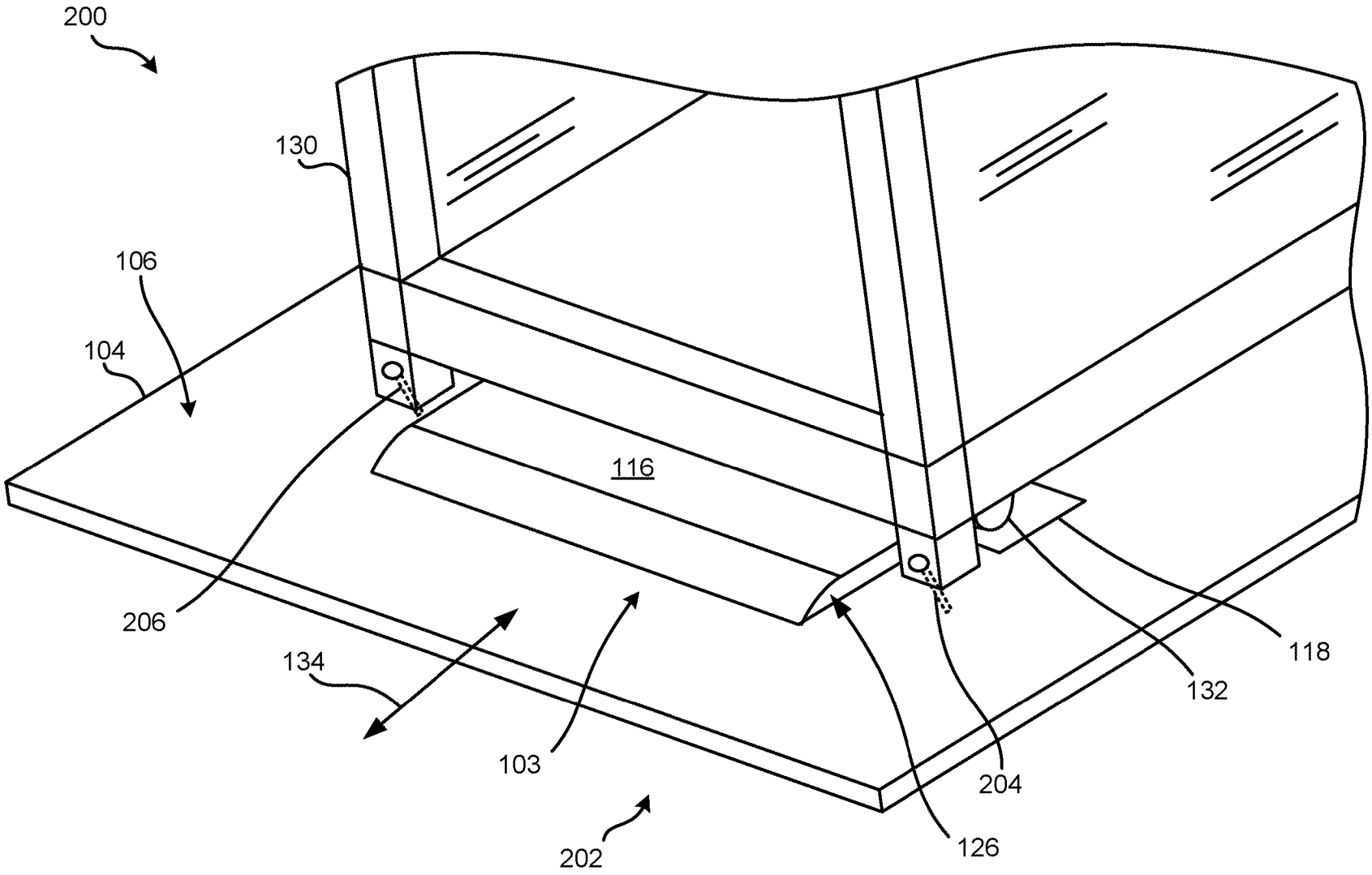
FIG. 2 is a partial perspective view of a system having an apparatus with a base, elastic components arranged thereon, and a device, according to one embodiment.

Referring now to FIG. 2, system 200 includes an apparatus 202. The apparatus 202 includes a base 104 having at least three mounting points on an upper surface 106 thereof. Moreover, apparatus 202 includes at least two elastic pads 118 positioned in recesses in the upper surface 106 of the base 104. The apparatus 202 also includes an elastic panel 116 coupled to, and extending along, the upper surface 106 of the base 104 in a region 103 between the mounting points.

The apparatus 202 includes a device 130 mounted to the base 104 at the mounting points. In the current approach, the mounting points are covered by leg portions of the device 130.

According to various approaches, the device 130 may be mounted to the base 104 at the mounting points using any known coupling type. For example, as illustrated in FIG. 11, the device 130 is mounted to the base 104 at the mounting points by bolts 204, 206. In other approaches, other coupling types may include, e.g., adhesives, screws, latches, straps, etc.

Although the device 130 is in some contact with the base 104, forces are dampened and thereby prevented from damaging the device 130 by the elastic portions of the apparatus 202. For example, damping is provided to the device 130, as a result of wheels 132 of the device 130 resting on the elastic pads 118. Moreover, the elastic panel 116 dampens and thereby minimizes and/or prevents forces from being transferred to the device 130 from the base 104, as a result of the device 130 at least in part resting on the elastic panel 116.

Figure 3:
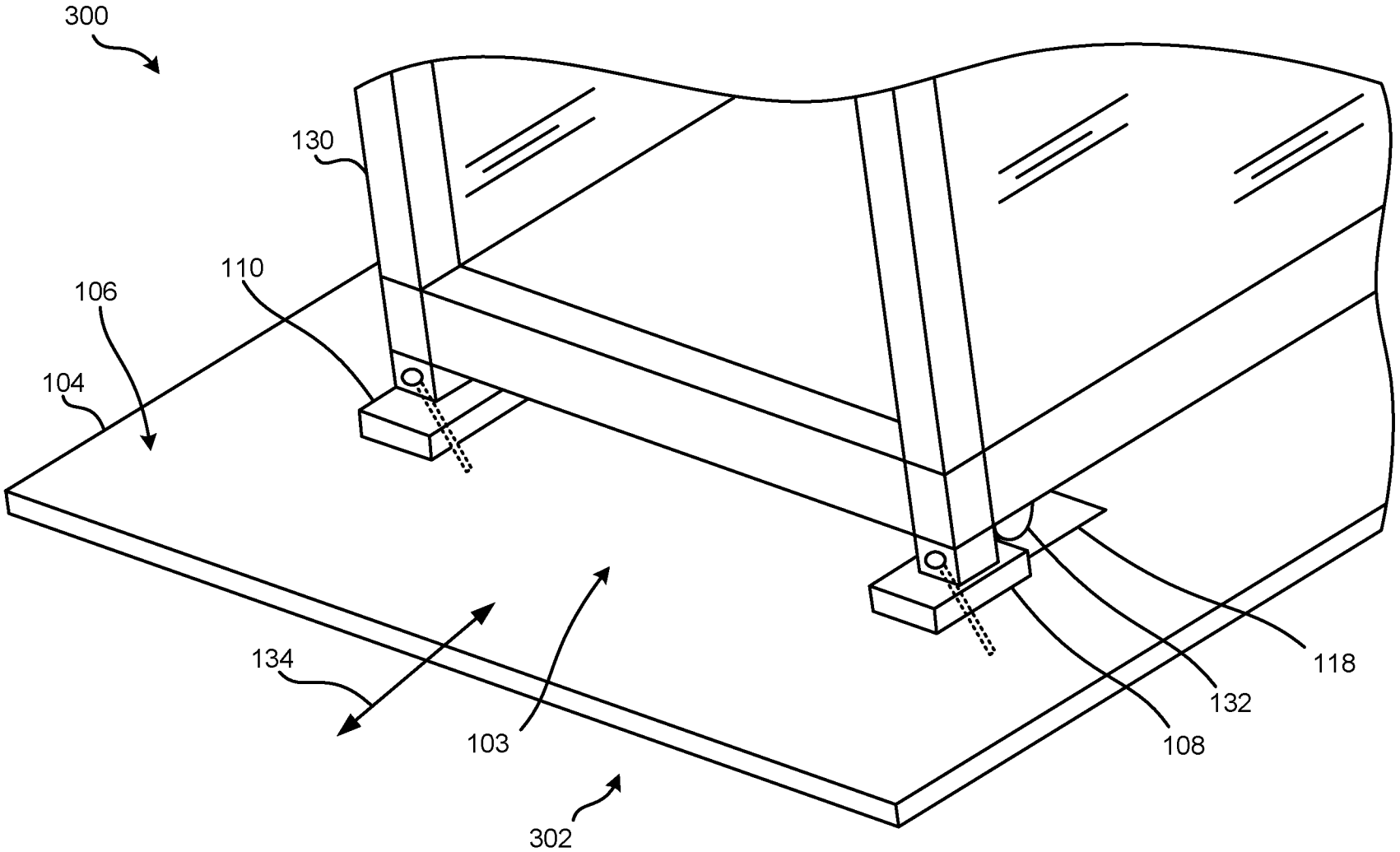
FIG. 3 is a partial perspective view of a system having an apparatus with a base, elastic components arranged thereon, and a device, according to one embodiment.

Referring now to FIG. 3, system 300 includes an apparatus 302. The apparatus 302 includes a base 104 having at least three mounting points on an upper surface 106 thereof. Moreover, apparatus 302 includes at least two elastic pads 118 positioned in recesses in the upper surface 106 of the base 104. The apparatus 302 also includes a device 130 mounted to the base 104 at the mounting points. The apparatus 302 yet further includes elastic blocks 108, 110 extending between the device 130 and the mounting points for providing damping.

In one approach, wheels 132 of the device 130 rest on the elastic pads 118, e.g., when the device is positioned on the base 104 for shipping.

Figure 4:
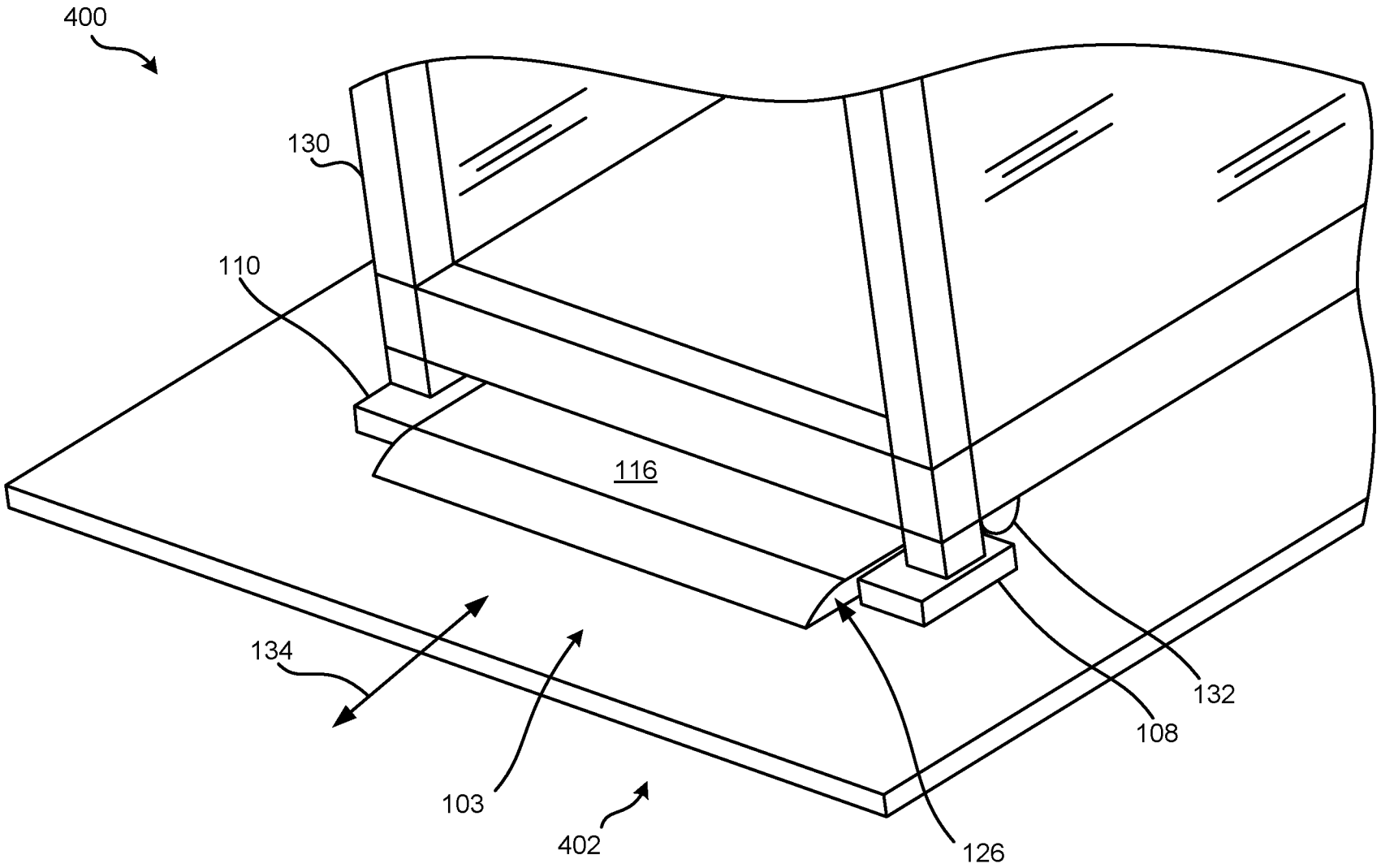
FIG. 4 is a partial perspective view of a system having an apparatus with a base, elastic components arranged thereon, and a device, according to one embodiment.

In another embodiment, referring now to FIG. 4, system 400 includes an apparatus 402. The apparatus 402 includes a base 104 having at least three mounting points on an upper surface 106 thereof. Note that in the current approach, various mounting points are covered by elastic blocks 108, 110, and moreover, other elastic blocks may be not shown. Moreover, apparatus 402 includes an elastic panel 116 coupled to, and extending along, the upper surface 106 of the base 104 in a region 103 between the mounting points.

The apparatus 402 also includes a device 130. Forces are dampened and thereby prevented from damaging the device 130 by at least one of the elastic blocks 108, 110 and/or the elastic panel 116.

Figure 5:
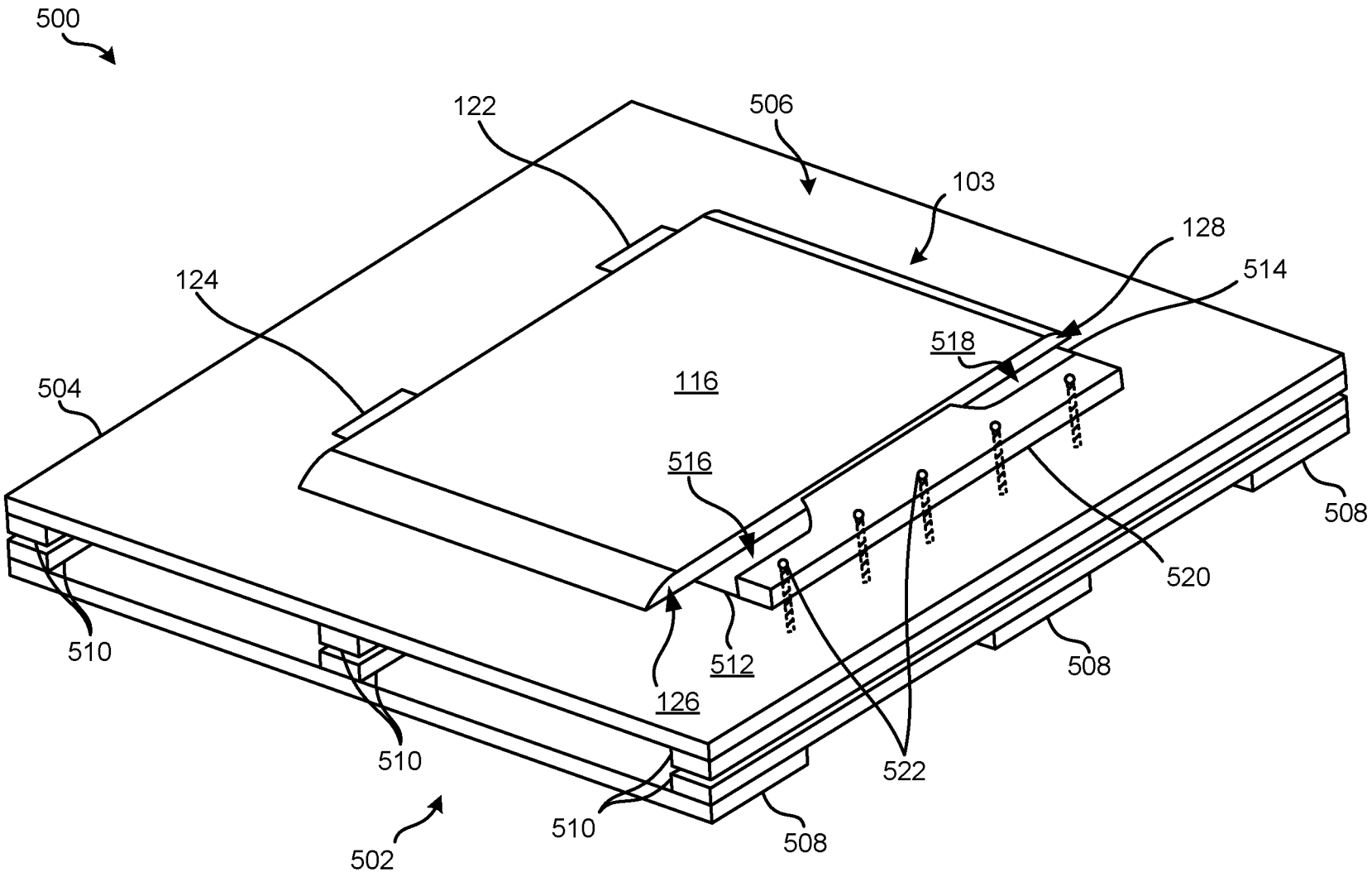
FIG. 5 is a perspective view of a system having an apparatus with a base and elastic components arranged thereon, according to one embodiment.

Referring now to FIG. 5, system 500 includes an apparatus 502. The apparatus 502 includes a base 504 having at least three mounting points on an upper surface 506 thereof. The base 504 further includes stacked layers. For example, the base 504 includes a lower layer which includes a plurality of blocks 508. Moreover, the base 504 includes a center layer, which includes a plurality of blocks 510. In the present approach, at least some of the blocks 510 of the center layer are stacked on top of one another.

According to various approaches, elastic material, e.g., elastic blocks, an elastic sheet, elastic wedges, etc., or any combination thereof, may be interleaved between any two or more portions of the base 504 (in addition to and/or as an alternative to the elastic portions that reside on the upper surface 506 of the base 504). For example, in one approach, elastic blocks may be interleaved between at least some of the blocks 510 of the center layer. Interleaving portions of elastic material with portions of the base 504 may provide additional damping of the apparatus 502. Of course, each of the portions of the base 504 may be coupled together, e.g., via screws, bolts, etc. passing through each of the layers of the base 504, for establishing a robust platform with damping elastic materials for allowing transport of a device safely thereon.

Apparatus 502 includes an elastic panel 116. Moreover, apparatus 502 includes various elastic pads 122, 124, 512, 514 positioned in recesses in the upper surface 506 of the base 104. Damping is provided to a device (not shown), in response to wheels of the device resting on the elastic pads 122, 124, 512, 514. Accordingly, in the present approach, the mounting points of the apparatus 502 reside at about the location of the elastic pads 122, 124, 512, 514.

In one approach, apparatus may include an elastic block 520 configured to sandwich portions of the device, e.g., wheel(s), legs, arms, etc., in the spaces 516, 518 between the elastic block 520 and the elastic panel 116. In the present approach, the elastic block 520 is coupled to the base 504 with screws 522, however, in other approaches, the elastic block 520 may be coupled to the base 504 using any known type of coupling.

It should be noted that the spaces 516, 518 between the elastic block 520 and the elastic panel 116 may be adjusted to accommodate a broad range device portions there-between the elastic block 520 and the elastic panel 116.

Various embodiments and/or approaches described herein may be implemented for protecting a device from experiencing shock and/or random vibration that would otherwise damage the device and/or components within the device. Establishing such a robust yet reinforcing apparatus is very important for safely and reliably delivering hardware systems to customers. This is because during the shipping of devices, devices are commonly subjected to a wide variety of potentially damaging forces. If such forces are able to damage the device, a customer will likely return the device for replacement and/or refund. Accordingly, operational costs may be reduced in response to shipping a device using one or more of the various apparatuses described herein.

Specifically, as a result of various apparatuses described herein including different materials, e.g., wood, plastic, elastic material, etc., such apparatuses are able to resist damage, yet be sufficiently rigid to withstand most impacts experienced by a crate during shipment. For example, in testing, such materials allowed apparatuses to support the weight of a device such as a computer-related rack and drawer systems with significantly reduced shock and vibration transfer, despite such apparatuses being subjected to dynamic shock and vibration. Accordingly, a computer rack having one or more computers stored therein will likely experience only a non-damaging amounts of force when transported on one or more of the apparatuses described herein. This is because the amount of force transmissibility is completely dampened or dampened to only an amount that will result in a negligible amount of damage to the device components, e.g., cards, display equipment, connectors, sheet metal, etc.

Additionally, such elastic components may improve transmissibly and sensitivity of both resonance frequency and transmissibility to system weight variation.

It will be clear that the various features of the foregoing systems and/or methodologies may be combined in any way, creating a plurality of combinations from the descriptions presented above.

It will be further appreciated that embodiments of the present invention may be provided in the form of a service deployed on behalf of a customer.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. An apparatus, comprising:

a base having at least three mounting points on an upper surface thereof, wherein the at least three mounting points reside along a common plane;

elastic blocks above the mounting points; and a single elastic panel coupled to, and extending along, the upper surface of the base in a region between the mounting points, wherein the elastic panel lies directly on the upper surface of the base, wherein the elastic panel extends from a first of the at least three mounting points to a second of the at least three mounting points, wherein the elastic panel extends from a bottom edge of the elastic block above the first mounting point to a bottom edge of the elastic block above the second mounting point, the bottom edges of the elastic blocks being in direct contact with the associated mounting points.

2. An apparatus as recited in claim 1, wherein the elastic panel is coupled to the upper surface of the base by a component selected from the group consisting of: a magnet and a hook and loop fastener.

3. An apparatus as recited in claim 1, wherein the base is a plastic panel.

4. An apparatus as recited in claim 1, comprising at least two elastic pads positioned in recesses in the upper surface of the base, wherein a first of the recesses is located directly adjacent the first of the at least three mounting points, wherein a second of the recesses is located directly adjacent the second of the at least three mounting points.

5. An apparatus as recited in claim 4, wherein upper surfaces of the elastic pads are about coplanar with the upper surface of the base.

6. An apparatus as recited in claim 1, wherein the elastic panel has a tapered end.

7. An apparatus as recited in claim 1, comprising a device mounted to the base at the mounting points, wherein the elastic blocks extend between the device and the mounting points to provide damping.

8. An apparatus as recited in claim 7, comprising at least two elastic pads positioned in recesses in the upper surface of the base, wheels of the device resting on the elastic pads.

9. An apparatus, comprising:

a base having at least three mounting points on an upper surface thereof;

elastic blocks above the mounting points, wherein two of the at least three mounting points are positioned on the upper surface of a front portion of the base, wherein the elastic blocks above the two mounting points positioned on the upper surface of the front portion of the base are configured to be detachably coupled to the mounting points, thereby selectively blocking wheels of a device from being rolled off of the base in a first direction that extends from a back portion of the base to the front portion of the base, wherein one of the at least three mounting points is positioned on the upper surface of the back portion of the base, wherein the elastic block above the mounting point positioned on the upper surface of the back portion of the base is configured to be detachably coupled to the mounting point, thereby selectively blocking the wheels of the device from being rolled off of the base in a second direction that extends from the front portion of the base to the back portion of the base; and at least two elastic pads positioned in recesses in the upper surface of the base.

10. An apparatus as recited in claim 9, wherein the elastic blocks above the two mounting points positioned on the upper surface of the front portion of the base are configured to be detachably coupled to the mounting points by magnets.

11. An apparatus as recited in claim 9, comprising a single elastic panel coupled to, and extending along, the upper surface of the base in a region between the two mounting points positioned on the upper surface of the front portion of the base, wherein the elastic panel extends, in the first direction, beyond the elastic blocks above the two mounting points positioned on the upper surface of the front portion of the base.

12. An apparatus as recited in claim 9, wherein upper surfaces of the elastic pads reside below the upper surface of the base.

13. An apparatus as recited in claim 9, comprising a device mounted to the base at the mounting points, wheels of the device resting on the elastic pads and legs of the device resting on the elastic blocks, wherein the elastic blocks extend between the device and the mounting points to provide damping.

14. An apparatus as recited in claim 13, comprising a single elastic panel coupled to, and extending along, the upper surface of the base in a region between the two mounting points positioned on the upper surface of the front portion of the base.

15. An apparatus as recited in claim 14, wherein the single elastic panel has a first tapered end that tapers toward the front portion of the base and a second tapered end that tapers toward the back portion of the base.

16. An apparatus, comprising:

a base having at least three mounting points on an upper surface thereof;

a single elastic panel coupled to, and extending along, the upper surface of the base in a region between the mounting points, wherein the elastic panel extends from a first of the at least three mounting points to a second of the at least three mounting points; and at least two elastic pads positioned in recesses in the upper surface of the base, wherein upper surfaces of the elastic pads reside below the upper surface of the base.

17. An apparatus as recited in claim 16, wherein the elastic panel extends continuously to all of the mounting points.

18. An apparatus as recited in claim 16, comprising a device mounted to the base at the mounting points, wheels of the device resting on the elastic pads.

19. An apparatus as recited in claim 18, comprising elastic blocks extending between the device and the mounting points to provide damping.

* * * * *